US008968022B2

(12) United States Patent
Mostoller et al.

(10) Patent No.: US 8,968,022 B2
(45) Date of Patent: Mar. 3, 2015

(54) ELECTRICAL CONNECTOR HAVING POKE-IN WIRE CONTACT

(71) Applicant: Tyco Electronics Corporation, Berwyn, PA (US)

(72) Inventors: Matthew Edward Mostoller, Hummelstown, PA (US); Christopher George Daily, Harrisburg, PA (US); Edward John Howard, Millersburg, PA (US); Alexander Hunt, III, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 61 days.

(21) Appl. No.: 13/776,216

(22) Filed: Feb. 25, 2013

(65) Prior Publication Data

US 2014/0242833 A1 Aug. 28, 2014

(51) Int. Cl.

| | |
|---|---|
| ***H01R 4/48*** | (2006.01) |
| *H01R 12/70* | (2011.01) |
| *H01R 13/11* | (2006.01) |

(52) U.S. Cl.

CPC ..... *H01R 4/4818* (2013.01); *H01R 4/4836* (2013.01); *H01R 12/7088* (2013.01); *H01R 13/11* (2013.01)

USPC ..... 439/438

(58) Field of Classification Search

USPC ..... 439/438, 441, 268, 267, 834, 835, 828

See application file for complete search history.

(56) References Cited

U.S. PATENT DOCUMENTS

| | | | | |
|---|---|---|---|---|
| 3,796,987 | A | 3/1974 | Kinkaid et al. | |
| 4,895,526 | A * | 1/1990 | Henrici et al. | 439/108 |
| 5,453,023 | A | 9/1995 | Capper et al. | |
| 5,525,070 | A | 6/1996 | Axelsson | |
| 5,860,837 | A * | 1/1999 | Bock et al. | 439/828 |
| 5,902,142 | A * | 5/1999 | Kondo et al. | 439/267 |
| 6,244,904 | B1 * | 6/2001 | Fabian et al. | 439/656 |

(Continued)

FOREIGN PATENT DOCUMENTS

| | | |
|---|---|---|
| DE | 19735835 | 2/1999 |
| DE | 202006000380 | 2/2007 |

(Continued)

OTHER PUBLICATIONS

European Search Report, Mail Date, May 28, 2014, EP 14 15 6368, International Application No. 1415638.4-1801.

(Continued)

*Primary Examiner* — Alexander Gilman

(57) ABSTRACT

An electrical connector includes a housing having a receptacle that is configured to receive an electrical wire therein. An electrical contact is held by the housing. The electrical contact includes a contact beam that includes a wire interface that is configured to engage the electrical wire. The contact beam is movable between a closed position and an open position. The wire interface is configured to engage the electrical wire when the contact beam is in the closed position. The wire interface is configured to be disengaged from the electrical wire when the contact beam is in the open position. The electrical connector includes a push-button actuator having a resiliently deflectable spring that is configured to slidably engage the contact beam to thereby move the contact beam from the closed position to the open position.

20 Claims, 7 Drawing Sheets

(56) References Cited

U.S. PATENT DOCUMENTS

| | | | | |
|---|---|---|---|---|
| 6,682,364 | B2 * | 1/2004 | Cisey | 439/441 |
| 6,783,385 | B2 * | 8/2004 | Rudy | 439/438 |
| 7,204,727 | B2 | 4/2007 | Germani | |
| 7,485,015 | B2 | 2/2009 | Coffy | |
| 7,628,640 | B2 | 12/2009 | Radle | |
| 8,328,586 | B2 * | 12/2012 | Bies et al. | 439/725 |
| 8,535,084 | B2 * | 9/2013 | Koellmann | 439/441 |
| 8,550,838 | B2 * | 10/2013 | Osagle et al. | 439/441 |
| 2010/0267292 | A1 * | 10/2010 | Pueschner et al. | 439/834 |
| 2011/0250775 | A1 | 10/2011 | Bies et al. | |
| 2011/0250803 | A1 * | 10/2011 | Bies | 439/752.5 |
| 2013/0029529 | A1 | 1/2013 | Osagie | |
| 2014/0113502 | A1 * | 4/2014 | Barber et al. | 439/709 |

FOREIGN PATENT DOCUMENTS

| | | |
|---|---|---|
| DE | 102005048972 | 4/2007 |
| WO | WO2010146525 | 12/2010 |

OTHER PUBLICATIONS

ISR Notification for PCT/US2012/047271 dated Jul. 19, 2012.

* cited by examiner

ELECTRICAL CONNECTOR HAVING POKE-IN WIRE CONTACT

BACKGROUND OF THE INVENTION

The subject matter described herein relates generally to an electrical connector having a poke-in wire contact.

Some electrical connectors terminate electrical wires. Such electrical connectors include an electrical contact that engages an electrical wire to establish an electrical connection therebetween. The electrical contacts of some electrical connectors that terminate electrical wires are poke-in wire contacts. Poke-in wire contacts include wire interfaces that extend within a receptacle of the electrical connector. The electrical wire is inserted, or poked, into the receptacle such that the electrical wire engages, and thereby forms an electrical connection with, the wire interface of the poke-in wire contact.

Poke-in wire contacts are not without their disadvantages. For example, in some circumstances the electrical wire is removed from the receptacle to facilitate product testing, inspection, replacement, and/or repair of the electrical connector. But, it may be difficult to release the electrical wire from the poke-in contact and thereby remove the electrical wire from the receptacle without damaging the electrical wire and/or the poke-in contact. Damage to the electrical wire and/or the poke-in contact may require otherwise unnecessary repair and/or replacement of the electrical wire and/or the poke-in contact, which may increase a cost of the electrical connector.

Moreover, at least some known poke-in contacts require a special dedicated tool to release the electrical wire from the contact. The special dedicated tool may not be readily available in the field and therefore may not be used. Instead, an operator may use another tool that was not designed to release the electrical wire from the poke-in contact, which may damage the electrical connector.

The housings of some known electrical connectors include a flexible member that pushes on the poke-in contact to release the electrical wire from the contact. But, the plastic or similar material of the housing may become brittle when the electrical connector is exposed to the heat of a solder reflow process, which may damage the flexible member. For example, heat from the solder reflow process may reduce the elastic range of the flexible member and/or cause the flexible member to fracture, break, and/or the like. The damage may cause the flexible member to fail to sufficiently push on the poke-in contact, which may render the electrical wire as unreleasable from the poke-in contact.

SUMMARY OF THE INVENTION

In one embodiment, an electrical connector includes a housing having a receptacle that is configured to receive an electrical wire therein. An electrical contact is held by the housing. The electrical contact includes a contact beam that includes a wire interface that is configured to engage the electrical wire. The contact beam is movable between a closed position and an open position. The wire interface is configured to engage the electrical wire when the contact beam is in the closed position. The wire interface is configured to be disengaged from the electrical wire when the contact beam is in the open position. The electrical connector includes a push-button actuator having a resiliently deflectable spring that is configured to slidably engage the contact beam to thereby move the contact beam from the closed position to the open position.

In another embodiment, an electrical connector includes a housing having a receptacle that is configured to receive an electrical wire therein. An electrical contact is held by the housing. The electrical contact includes a contact beam that includes a wire interface that is configured to engage the electrical wire. The contact beam is movable between a closed position and an open position. The wire interface is configured to engage the electrical wire when the contact beam is in the closed position. The wire interface is configured to be disengaged from the electrical wire when the contact beam is in the open position. The electrical connector includes a push-button actuator having a spring that is configured to be resiliently deflected and thereby moved relative to the contact beam such that slidable engagement between the spring and the contact beam moves the contact beam from the closed position to the open position.

In another embodiment, an electrical connector includes a housing having a receptacle that is configured to receive an electrical wire therein. An electrical contact is held by the housing. The electrical contact includes a contact beam that includes a wire interface that is configured to engage the electrical wire. The contact beam has a wire side and an opposite side. The wire side includes the wire interface of the contact beam. The contact beam is movable between a closed position and an open position. The wire interface is configured to engage the electrical wire when the contact beam is in the closed position. The wire interface is configured to be disengaged from the electrical wire when the contact beam is in the open position. The electrical connector includes a push-button actuator having a resiliently deflectable spring and a spring beam. The spring is configured to slidably engage the contact beam to thereby move the contact beam from the closed position to the open position. The spring beam is engaged in physical contact with the opposite side of the contact beam for biasing the contact beam to the closed position.

DETAILED DESCRIPTION OF THE DRAWINGS

Figure 1:
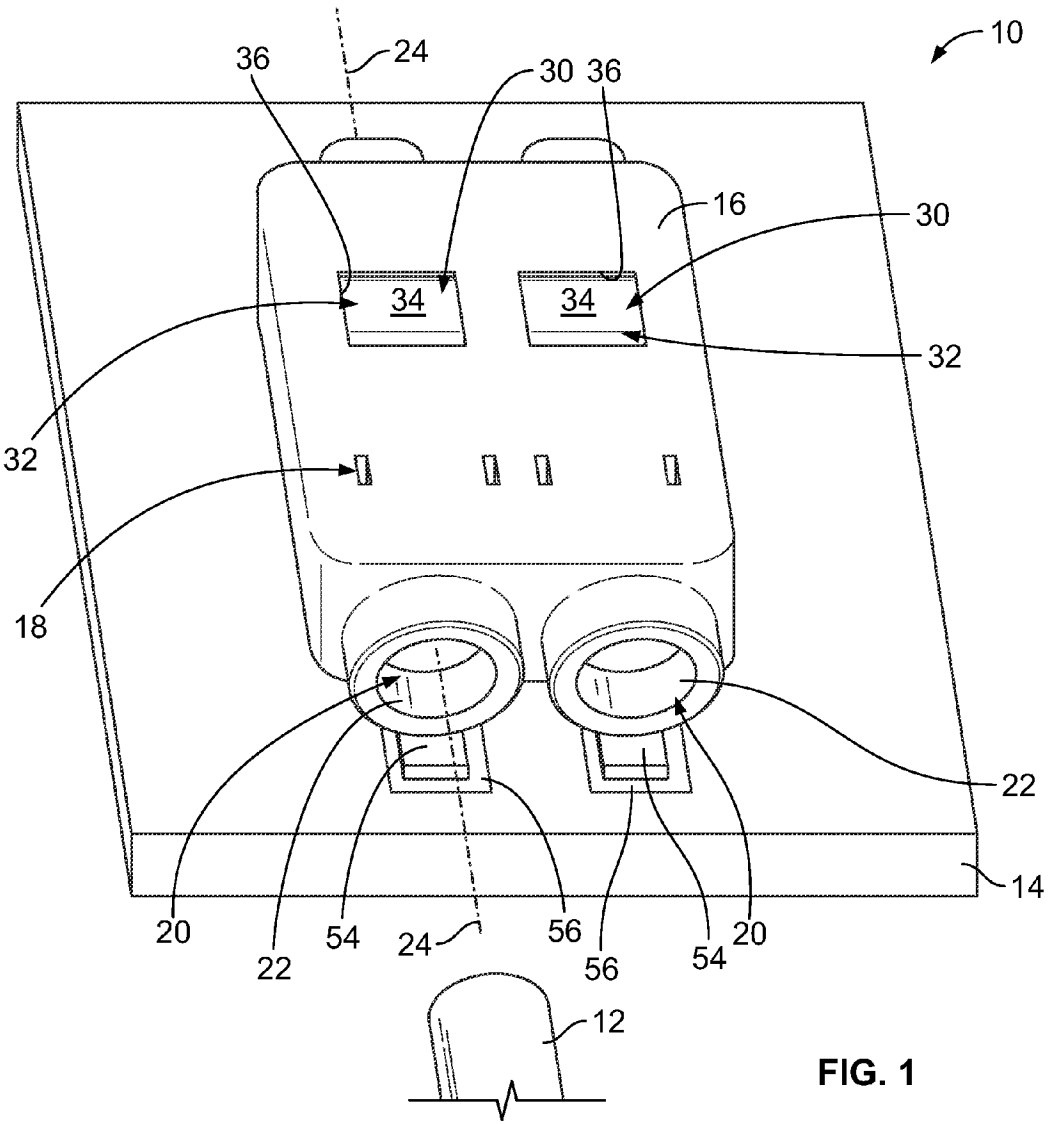
FIG. 1 is a perspective view of an exemplary embodiment of an electrical connector.

FIG. 1 is a perspective view of an exemplary embodiment of an electrical connector 10. The electrical connector 10 is configured to electrically connect to one or more electrical wires 12. The electrical wires 12 may or may not be grouped together in a cable (not shown). In the exemplary embodiment, the electrical connector 10 is mounted on a substrate 14 for providing an electrical path between the electrical wires 12 and the substrate 14. In other embodiments, the electrical connector 10 terminates one or more other electrical wires (not shown) for providing an electrical path between the electrical wires 12 and the other electrical wires. The other electrical wires may or may not be grouped together in a cable (not shown). The substrate 14 may be any type of substrate, such as, but not limited to, a circuit board and/or the like.

Figure 2:
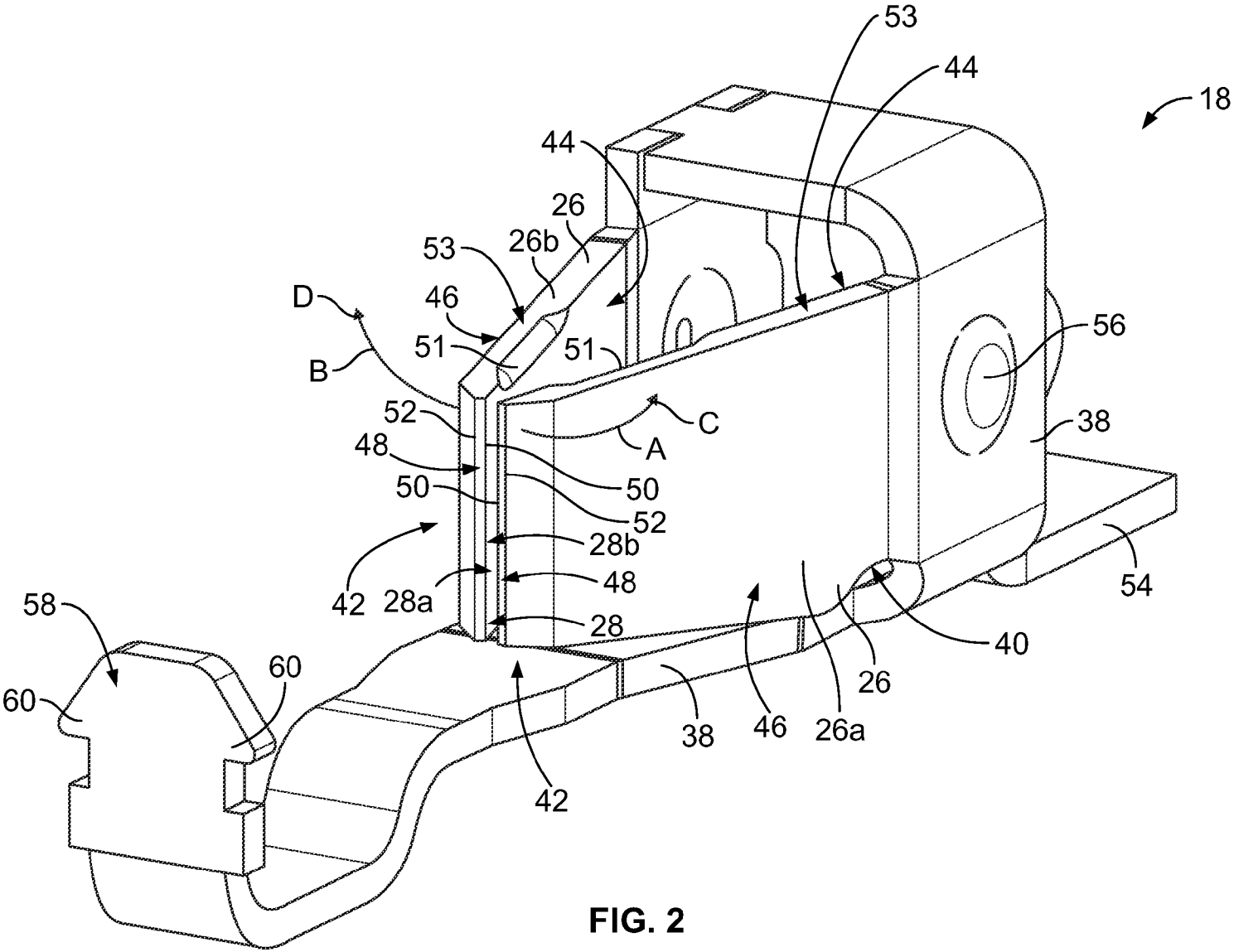
FIG. 2 is a perspective view of an exemplary embodiment of an electrical contact of the electrical connector shown in FIG. 1.
Figure 3:
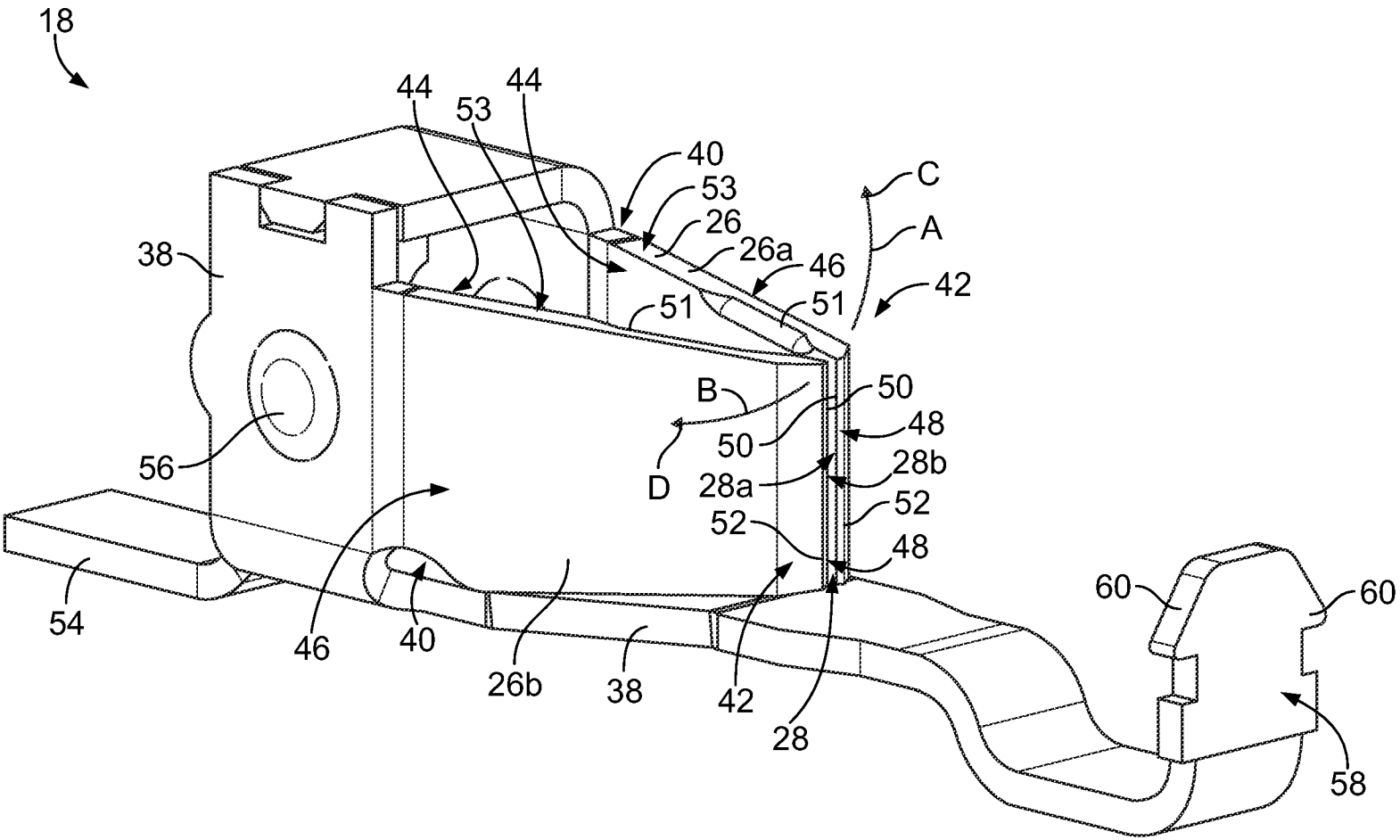
FIG. 3 is another perspective view of the electrical contact shown in FIG. 2 viewed from a different angle than FIG. 2.

The electrical connector 10 includes a housing 16 and one or more electrical contacts 18 (better illustrated in FIGS. 2 and 3). The electrical contacts 18 are poke-in contacts. For example, the housing 16 includes one or more receptacles 20. The electrical contacts 18 are held within the receptacles 20. Each receptacle 20 is configured to receive a corresponding electrical wire 12 therein. Specifically, the receptacles 20 include entrances 22 through which electrical wires 12 are inserted. In other words, the electrical wires 12 are inserted, or poked, into the receptacles 20 through the entrances 22. Each receptacle 20 receives the corresponding electrical wire 12 therein along an insertion axis 24. Once the electrical wires 12 are poked into the receptacles 20, each electrical wire 12 engages, and thereby electrically connects to, the corresponding electrical contact 18 to establish an electrical connection between the electrical connector 10 and the electrical wire 12.

As will be described below, the electrical contacts 18 include contact beams 26 (FIGS. 2, 3, and 5-9) that have wire interfaces 28 (FIGS. 2, 3, and 7-9). The contact beams 26 are movable between open and closed positions. In the closed position, the wire interface 28 is configured to engage the corresponding electrical wire 12. In the open position, the wire interface 28 is configured to be disengaged from the corresponding electrical wire 12. Push-button actuators 30 are provided for moving the contact beams 26 from the closed positions to the open positions to thereby enable the electrical wires 12 to be removed from the receptacles 20. Optionally, the push-button actuators 30 are used to move the contact beams 26 from the closed positions to the open positions for insertion of the electrical wires 12 into the receptacles 20. As will be described in more detail below, each push-button actuator 30 includes a resiliently deflectable spring 32 that is configured to slidably engage the contact beam(s) 26 of a corresponding electrical contact 18 to thereby move the contact beam(s) 26 from the closed position to the open position. The spring 32 of each push-button actuator 30 includes a push button 34 that is configured to be pushed to slide the spring 32 along the contact beam(s) 26 of the corresponding electrical contact 18. As can be seen in FIG. 1, the push buttons 34 are exposed through corresponding windows 36 of the housing 16.

The electrical connector 10 may include any number of push-button actuators 30 for slidable engagement with any number of electrical contacts 18, whether or not the number of push button actuators 30 is the same as the number of electrical contacts 18. Although two windows 36 are shown for exposing two push buttons 34, the housing 16 may include any number of windows 36 for exposing any number of push buttons 34, whether or not the number of windows 34 is the same as the number of push buttons 34. For example, in an exemplary alternative embodiment, the housing 16 may include a single window 36 that exposes two or more push buttons 34.

Although two are shown, the housing 16 may include any number of receptacles 20 for receiving any number of electrical wires 12. Each receptacle 20 may receive any number of electrical wires 12 therein. In the exemplary embodiment, each receptacle 20 receives a single corresponding electrical wire 12 therein. Only one electrical wire 12 is shown in FIG. 1 for clarity. The housing 16 may hold any number of electrical contacts 18. In the exemplary embodiment, the housing 16 holds four electrical contacts 18. Each receptacle 20 may hold any number of electrical contacts 18 therein. In the exemplary embodiment, each receptacle 20 holds a single corresponding electrical contact 18. Each electrical contact 18 may engage, and thereby electrically connect to, any number of electrical wires 12. In the exemplary embodiment, each electrical contact 18 engages a single corresponding electrical wire 12.

FIGS. 2 and 3 are perspective views of an exemplary embodiment of the electrical contact 18. The electrical contact 18 includes a base 38 and one or more of the contact beams 26. The contact beams 26 extend from the base 38. Each contact beam 26 extends a length from an end 40 to an opposite end 42. The contact beams 26 include inner sides 44, outer sides 46 that are opposite the inner sides 44, and end sides 48. The end sides 48 intersect the inner sides 44 at edges 50. The edge 50 may be considered a portion of the inner side 44 and/or a portion of the end side 48. In other words, the inner side 44 and/or the end side 48 may be considered to include the edge 50. The end sides 48 intersect the outer sides 46 at edges 52. The end 42 of each of the contact beams 26 include the edges 50 and 52, the end side 48, a portion of the inner side 44 that extends adjacent the edge 50, and a portion of the outer side 46 that extends adjacent the edge 52. The inner side 44 may be referred to herein as a "wire side", while the outer side 46 may be referred to herein as an "opposite side".

The contact beams 26 also include actuation surfaces 51 where the spring 32 slidably engages the contact beams 26. The actuation surfaces 51 are edges that extend between the inner sides 44 and edge sides 53 of the contact beams 26. The actuation surfaces 51 may be considered edges of the inner sides 44 and/or of the edge sides 53. In the exemplary embodiment, each actuation surface 51 is a rounded surface that defines a rounded edge that extends between the inner side 44 and an edge side 53 of the corresponding contact beam 26. Alternatively, one or both actuation surfaces 51 is an approximately flat surface that defines an approximately flat edge that extends between the inner side 44 and the edge side 53. In still other alternative embodiments, one or both of the actuation surfaces 51 is a pointed (i.e., sharp) surface that defines a pointed edge that extends between the inner side 44 and the edge side 53. The actuation surfaces 51 are not limited to the location along the length of the contact beams 26 shown herein. Rather, the actuation surfaces 51 may have any other location along the lengths of the contact beams 26 that enables the actuation surfaces 51 to function as described and/or illustrated herein.

The contact beams 26 include the wire interfaces 28 where the contact beams 26 are configured to engage the corresponding electrical wire 12 (FIGS. 1, 8, and 9) to thereby form an electrical connection between the electrical contact 18 and the corresponding electrical wire 12. For each contact beam 26, the wire interface 28 may or may not press into the corresponding electrical wire 12 when wire interface 28 is engaged with the corresponding electrical wire 12. In the exemplary embodiment, the wire interface 28 of each contact beam 26 is at least partially defined by the edge 50. In other words, in the exemplary embodiment, the wire interface 28 includes the edge 50. A portion of the end side 48 that is adjacent the edge 50 and/or a portion of the inner side 44 that is adjacent the edge 50 may also engage the corresponding electrical wire 12, for example in embodiments wherein the contact beam 26 presses into the corresponding electrical wire 12. In other words, in some embodiments, the wire interface 28 includes a portion of the end side 48 that is adjacent the edge 50 and/or a portion of the inner side 44 that is adjacent the edge 50. In addition or alternatively to the edge 50, a portion of the end side 48 that is adjacent the edge 50, a portion of the inner side 44 that is adjacent the edge 50, and/or any other location(s) along the contact beam 26 may define a portion or an entirety of the wire interface 28 of the contact beam 26.

In the exemplary embodiment, the electrical contact 18 includes two contact beams 26, namely the contact beams 26*a* and 26*b*. But, the electrical contact 18 may include any number of contact beams 26. For example, in some alternative embodiments, the electrical contact 18 includes a single contact beam 26 (e.g., the contact beam 26*a* or the contact beam 26*b*). The inner sides 44 of the contact beams 26*a* and 26*b* oppose each other. The contact beams 26*a* and 26*b* include respective wire interfaces 28*a* and 28*b* that oppose each other. In the exemplary embodiment, the corresponding electrical wire 12 is configured to be received and secured between the wire interfaces 28*a* and 28*b* of the contact beams 26*a* and 26*b*, respectively. In embodiments wherein the wire interface 28*a* and/or the wire interface 28*b* presses into the corresponding electrical wire 12, the corresponding electrical wire 12 is compressed between the wire interfaces 28*a* and 28*b* of the contact beams 26*a* and 26*b*, respectively. Each of the contact beams 26*a* and 26*b* may be referred to herein as a "first" and/or a "second" contact beam. The wire interfaces 28*a* and 28*b* may each be referred to herein as a "first" and/or a "second" wire interface.

Figure 7:
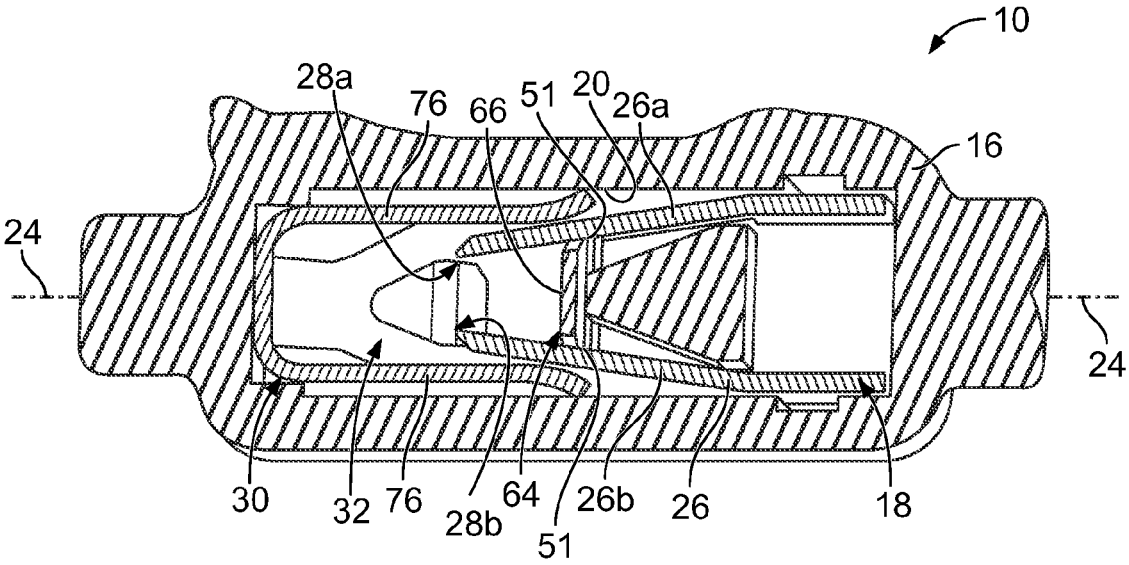
FIG. 7 perspective view of a cross section of a portion of the electrical connector shown in FIGS. 1, 5, and 6 illustrating an exemplary embodiment of a spring of the push-button actuator shown in FIG. 4 as deflected.
Figure 8:
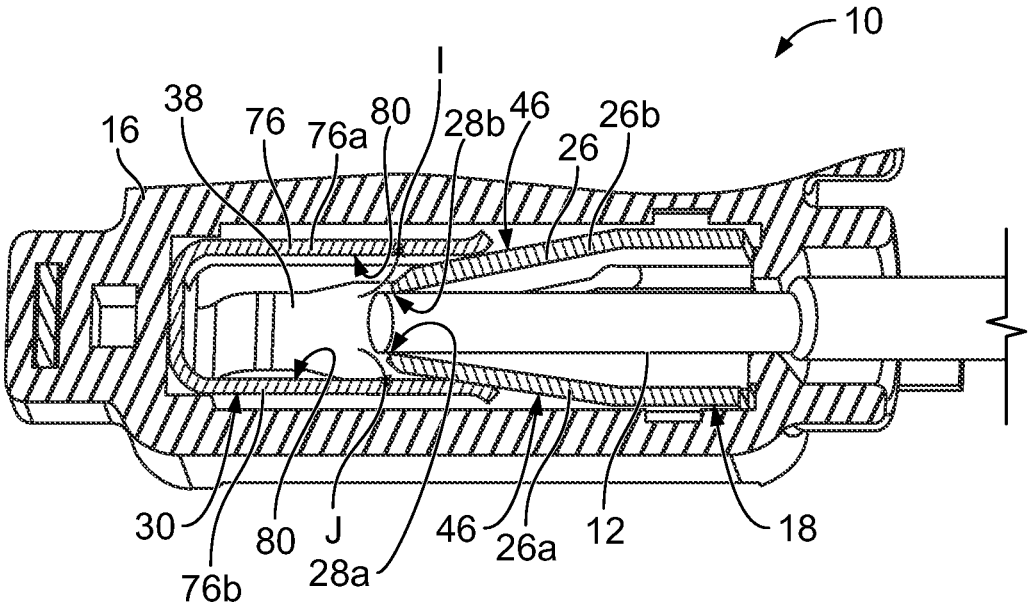
FIG. 8 is a perspective view of a cross-section of a portion of the electrical connector shown in FIGS. 1 and 5-7 illustrating an exemplary electrical wire installed to the electrical contact of the electrical connector.

Each of the contact beams 26 is movable between an open position and one or more closed positions. Specifically, each contact beam 26*a* and 26*b* is moveable along a respective arc A and B between an open position and one or more closed positions. FIGS. 7 and 8 illustrate the open positions of the contact beams 26*a* and 26*b*. In the open position, the contact beam 26 is configured to be disengaged from the corresponding electrical wire 12. Specifically, the wire interface 28 of the contact beam 26 is configured to be disengaged from the corresponding electrical wire 12 when the contact beam 26 is in the open position. In at least one closed position, the contact beam 26 is configured to engage the corresponding electrical wire 12 at the wire interface 28.

In the exemplary embodiment, each contact beam 26 includes a fully closed position when the corresponding electrical wire 12 is not present and a partially closed position when the contact beam 26 is engaged with the corresponding electrical wire 12. The contact beams 26*a* and 26*b* are shown in the fully closed positions in FIGS. 2, 3, 5, and 6. FIG. 8 illustrates the partially closed positions of the contact beams 26*a* and 26*b*. Each contact beam 26 is movable from the fully closed position to the partially closed position to accommodate the presence of the corresponding electrical wire 12. Each contact beam 26 is further moveable from the partially closed position to the open position. In other words, each contact beam 26 is moveable from the fully closed position to the open position. In some alternative embodiments, one or more of the contact beams 26 is configured to engage the corresponding electrical wire 12 when the contact beam 26 is in the fully closed position.

As can be seen in both FIGS. 2 and 3, in the exemplary embodiment, the wire interfaces 28*a* and 28*b* of the respective contact beams 26*a* and 26*b* do not engage each other when the contact beams 26*a* and 26*b* are in the fully closed positions. But, alternatively the wire interfaces 28*a* and 28*b* engage each other when the contact beams 26*a* and 26*b*, respectively, are in the fully closed positions.

It should be understood that the open position of a contact beam 26 depends on the size of the corresponding electrical wire 12. For example, a position of a contact beam 26 that is open (wherein the contact beam 26 does not engage the corresponding electrical wire 12) with respect to a smaller-sized electrical wire 12 may be closed (wherein the contact beam 26 engages the corresponding electrical wire 12) with respect to a larger-sized electrical wire 12. The open position of a contact beam 26 may or may not be at the end of a range of movement of the contact beam 26. In other words, as a contact beam 26 is moved from the partially closed position to the open position, the contact beam 26 may or may not disengage from the corresponding electrical wire 12 before the contact beam 26 has reached an end of the range of movement of the contact beam 26. For example, the open position of a contact beam 26 may or may not be at the end of a range of deflection and/or an elastic range of the contact beam 26.

Optionally, one or more of the contact beams 26 is a spring that is resiliently deflectable from the fully closed position to the open position. The exemplary embodiment of each of the contact beams 26*a* and 26*b* is a spring that is resiliently deflectable from the fully closed position to the open position. In other words, the contact beams 26*a* and 26*b* are each resiliently deflectable along the respective arcs A and B in the respective directions C and D. The contact beams 26*a* and 26*b* are thus each resiliently deflectable from the fully closed position to the partially closed position, and from the partially closed position to the open position. In some alternative embodiments, the contact beam 26*a* and/or 26*b* is movable from a closed position to an open position without being resiliently deflectable from the closed position to the open position.

In the exemplary embodiment, the base 38 includes one or more surface-mount tails 54 that are configured to be surface mounted to contact pads 56 (FIG. 1) of the substrate 14 (FIG. 1), for example as is shown in FIG. 1. In addition or alternatively to the surface-mount tails 54, the base 38 and/or one or more other portions of the electrical contact 18 may include one or more other mounting structures, such as, but not limited to, a press-fit tail (not shown) that is configured to be press-fit into an electrical via (not shown) of the substrate 14, a solder tail (not shown) that is configured to be received within an opening (e.g., an electrical via) of the substrate 14, a structure that is configured to terminate an electrical wire, and/or the like. Although only one is shown, the electrical contact 18 may include any number of mounting structures (e.g., any number of the surface-mount tails 54).

The electrical contact 18 includes one or more retention structures that hold the electrical contact 18 within the corresponding receptacle 20 (FIGS. 1, 5, 7, and 9) of the housing 16 (FIGS. 1 and 5-9). In the exemplary embodiment, the contact beams 26 include embossments 56 that are configured to be received within corresponding voids (not shown) of the housing 16 with an interference fit. The electrical contact 18 also includes a barbed leg 58 that extends from the base 38 in the exemplary embodiment. The barbed leg 58 includes barbs 60 that are configured to engage the housing 16 with an interference fit to hold the electrical contact 18 within the corresponding receptacle 20. In addition or alternatively to the embossments 56 and/or the barbed leg 58, the electrical contact 18 may include one or more other structures for holding the electrical contact 18 within the corresponding receptacle 20, such as, but not limited to, a snap-fit structure (not shown), an opening (not shown) for staking the electrical contact 18 to the housing 16, and/or the like. Each of the embossments 56 and the barbed leg 58 may have any other location along the electrical contact 18. The electrical contact 18 may include any number of the embossments 56 and any number of the barbed leg 58.

Figure 4:
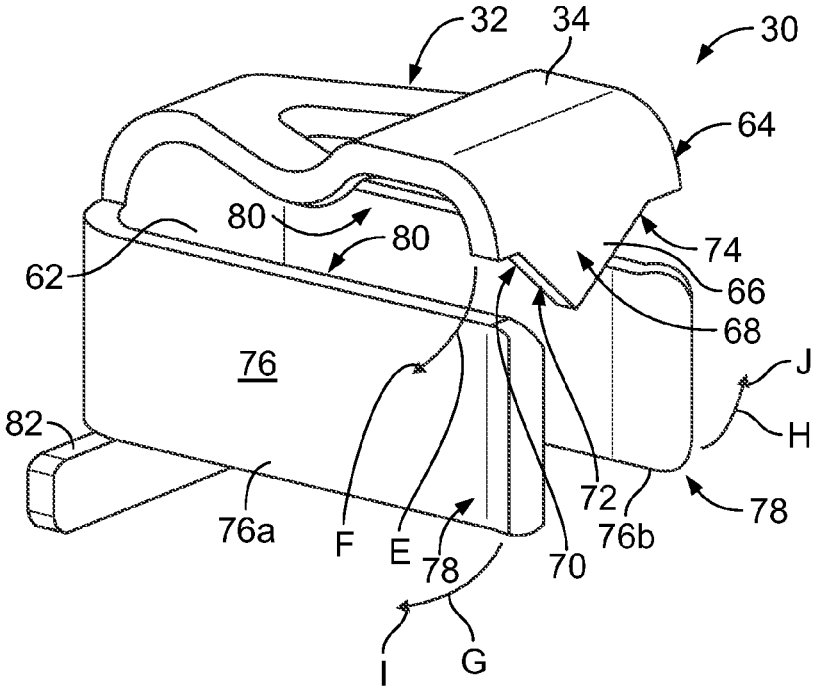
FIG. 4 is a perspective view of an exemplary embodiment of a push-button actuator of the electrical connector shown in FIG. 1.

FIG. 4 is a perspective view of an exemplary embodiment of a push-button actuator 30. The push-button actuator 30 includes a base 62 and the spring 32. The spring 32 extends a length outward from the base 62 to an end 64 of the spring 32. In the exemplary embodiment, the end 64 of the spring 32 includes a wedge 66. The wedge 66 includes opposite broad sides 68 and 70 and edge sides 72 and 74 that extend between the broad sides 68 and 70. As will be described below, the wedge 66 is configured to slidably engage the contact beams 26 (FIGS. 2, 3, and 5-9) of the corresponding electrical contact 18 (FIGS. 1-3 and 5-9) to move the contact beams 26 from the partially closed position to the open position and thereby enable the corresponding electrical wire 12 to be removed, or uninstalled, from the corresponding electrical contact 18. The wedge 66 is also configured to slidably engage the contact beams 26 of the corresponding electrical contact 18 to move the contact beams 26 from the fully closed position to the open position and thereby enable the corresponding electrical wire 12 to be installed to the corresponding electrical contact 18. The spring 32 may be referred to herein as an "actuator".

The edges sides 72 and 74 define actuation surfaces of the spring 32 where the wedge 66 slidably engages the contact beams 26 of the electrical contact 18. Specifically, the edge side 72 of the wedge 66 slidably engages the actuation surface 51 (FIGS. 2, 3, 6, and 7) of the contact beam 26*a*, while the edge side 74 slidably engages the actuation surface 51 of the contact beam 26*b*. It should be understood that in embodiments wherein the electrical contact 18 includes only a single contact beam 26, only one of the edges sides 72 or 74 will slidably engage the contact beam 26. The wedge 66 is not limited to being located at the end 64 of the spring 32. Rather, the wedge 66 may have any other location along the length of the spring 32 that enables the wedge 66 to function as described and/or illustrated herein.

The spring 32 is resiliently deflectable from a natural resting position of the spring 32. Specifically, the end 64 of the spring 32 is resiliently deflectable along an arc E in an actuation direction F. The spring 32 is shown in the natural resting position in FIG. 4. As will be described below, deflection of the spring 32 in the actuation direction F slides the wedge 66 of the spring 32 along the contact beams 26 in engagement therewith. In other words, the wedge 66 and the contact beams 26 slidably engage each other as the spring end 64 deflects in the actuation direction F.

The push button 34 of the spring 32 can be used to deflect the spring 32 in the actuation direction F and thereby slide the spring 32 along the contact beams 26. Although shown as being located at the end 64 of the spring 32, the push button 34 may have any other location along the length of the spring 32 that enables the push button 34 to function as described and/or illustrated herein. In some embodiments, and referring again to FIG. 1, the push buttons 34 and the windows 36 are configured (e.g., sized, shaped, positioned, and/or the like) such that a special dedicated tool is not required to push the push button 34 and thereby deflect the spring 32 in the actuation direction F. For example, a user may push the push button 34 and thereby deflect the spring 32 using a conventional tool (e.g., a pencil, a pen, a wire, a rod, and/or the like), using a body part (e.g., a person's finger, thumb, and/or the like), and/or the like.

Referring again to FIG. 4, the push-button actuator 30 includes one or more spring beams 76 that extend from the base 62. Each spring beam 76 extends a length outward from the base 62 to an end 78 of the spring beam 76. The spring beams 76 include inner sides 80. In the exemplary embodiment, the push-button actuator 30 includes two spring beams 76, namely the spring beams 76*a* and 76*b*. The inner sides 80 of the spring beams 76*a* and 76*b* oppose each other. Each of the spring beams 76*a* and 76*b* may be referred to herein as a "first" and/or a "second" spring beam.

Each spring beam 76*a* and 76*b* is resiliently deflectable from a natural resting position of the spring beam 76. Specifically, the ends 78 of the spring beams 76*a* and 76*b* are resiliently deflectable along a respective arc G and H in a respective direction I and J. The spring beams 76*a* and 76*b* are shown in the natural resting positions in FIG. 4.

As will be described below, the spring beams 76*a* and 76*b* are configured to engage in physical contact with the contact beams 26*a* and 26*b*, respectively, to increase the retention force provided by the contact beams 26. Although two are shown, the push-button actuator 30 may include any number of the spring beams 76, which may or may not be the same as the number of contact beams 26 of the electrical contact 18.

The push-button actuator 30 and the electrical contact 18 may each be fabricated from any material(s). Examples of materials of the electrical contact 18 include electrically conductive materials such as, but are not limited to, copper, gold, silver, aluminum, nickel, platinum, and/or the like. Optionally, the electrical contact 18 includes a base material (not shown) that is coated (e.g., plated and/or the like) with one or more different materials. Examples of materials of the push-button actuator 30 include, but are not limited to, steel, stainless steel, copper, gold, silver, aluminum, nickel, platinum, titanium, magnesium, and/or the like. Optionally, the push-button actuator 30 includes a base material (not shown) that is coated (e.g., plated and/or the like) with one or more different materials.

The push-button actuator 30 may or may not include any electrically conductive materials. In some embodiments, the push-button actuator 30 is fabricated from one or more metallic materials. For example, the spring 32 may be fabricated from one or more metallic materials. Fabricating the spring 32 and/or other portions of the push-button actuator 30 from one or more metallic materials may facilitate preventing damage to the spring 32 from heat experience during a solder reflow operation.

In some embodiments, the push-button actuator 30 is fabricated from one or more different materials than the electrical contact 18. For example, the spring beams 76 of the push-button actuator 30 may be fabricated from one or more different materials than the contact beams 26 of the electrical contact 18 to provide the spring beams 76 of the push-button actuator 30 with a greater yielding tensile strength than the contact beams 26 of the electrical contact 18.

The push-button actuator 30 includes one or more retention structures that hold the push-button actuator 30 within the corresponding receptacle 20 (FIGS. 1, 5, 7, and 9) of the housing 16 (FIGS. 1 and 5-9). In the exemplary embodiment, the base 62 includes barbs 82 that are configured to engage the housing 16 with an interference fit to hold the push-button actuator 30 within the corresponding receptacle 20. In addition or alternatively to the barbs 82, the push-button actuator 30 may include one or more other structures for holding the push-button actuator 30 within the corresponding receptacle 20, such as, but not limited to, a snap-fit structure (not shown), an opening (not shown) for staking the push-button actuator 30 to the housing 16, and/or the like. Each of the barbs 82 may have any other location along the push-button actuator 30. The push-button actuator 30 may include any number of the barbs 82. In the exemplary embodiment, the push-button actuator 30 includes two barbs 82 that extend outwardly from the base 62 in opposite directions.

Figure 5:
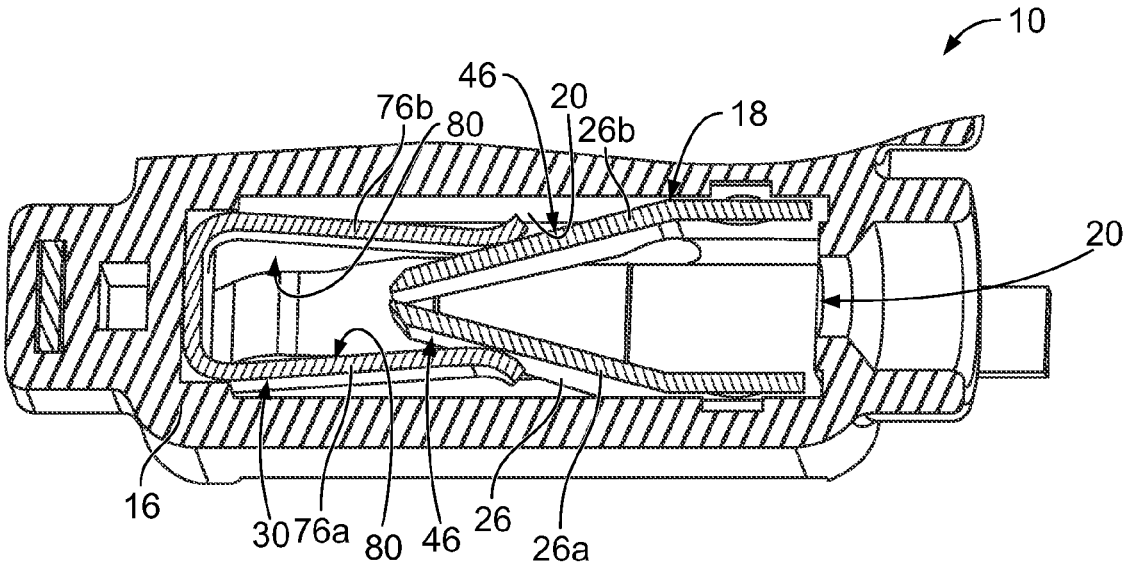
FIG. 5 is a perspective view of cross section of a portion of the electrical connector shown in FIG. 1.

FIG. 5 is a perspective view of a cross section of a portion of the electrical connector 10. FIG. 5 illustrates the push-button actuator 30 and the electrical contact 18 as held by the housing 16 without an electrical wire 12 being installed. Specifically, both the push-button actuator 30 and the electrical contact 18 are held within the corresponding receptacle 20 of the housing 16. As should be apparent from FIGS. 2-5, the push-button actuator 30 and the electrical contact 18 are discrete components from each other that are engaged in physical contact with one another. Accordingly, the spring 32 (not shown in FIG. 5) of the push-button actuator is a discrete component from the electrical contact 18. Alternatively, the push-button actuator 30 is integrally formed with the electrical contact 18.

The inner sides 80 of the spring beams 76*a* and 76*b* of the push-button actuator 30 are engaged in physical contact with the outer sides 46 of the contact beams 26*a* and 26*b*, respectively, of the electrical contact 18. In the exemplary embodiment, the contact beams 26*a* and 26*b* are received and engaged between the spring beams 76*a* and 76*b*, as can be seen in FIG. 5. As will be described below, the spring beams 76*a* and 76*b* are configured to increase the bias of the contact beams 26*a* and 26*b* to the partially and fully closed positions to thereby to increase the retention force that the contact beams 26*a* and 26*b* exert on the electrical wire 12. The contact beams 26*a* and 26*b* are shown in the fully closed positions in FIG. 5.

Figure 6:
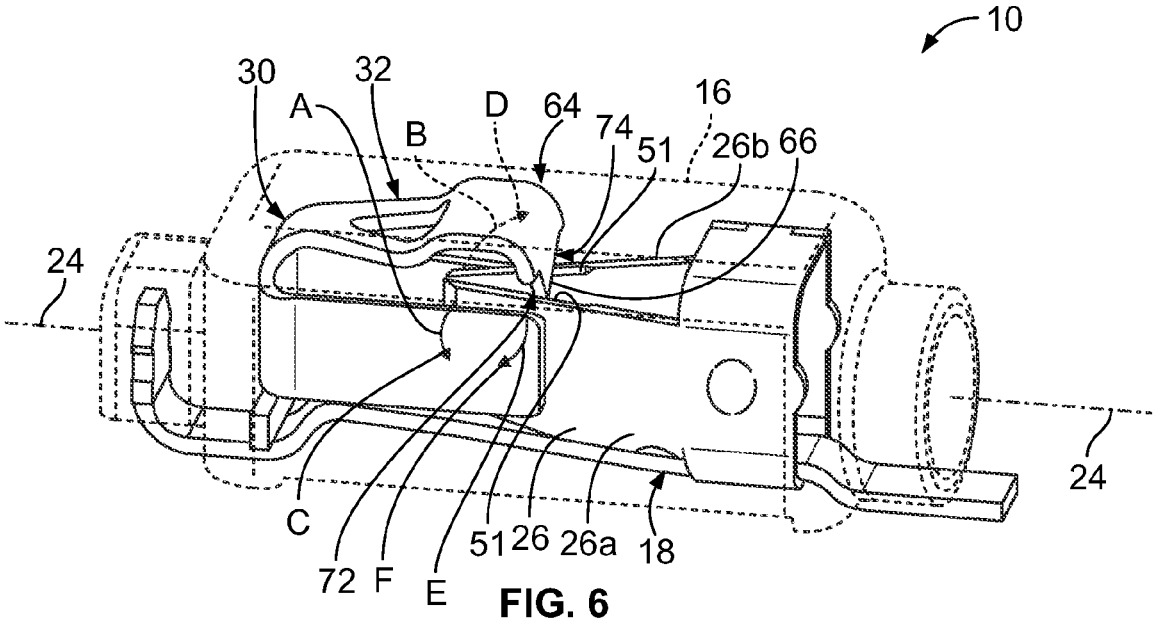
FIG. 6 is a perspective view of a portion of the electrical connector shown in FIGS. 1 and 5.

FIG. 6 is a perspective view of a portion of the electrical connector 10. FIG. 6 illustrates the push-button actuator 30 and the electrical contact 18 held by the housing 16 without an electrical wire 12 (FIGS. 1, 8, and 9) being installed. The housing 16 of the electrical connector 10 is shown in phantom in FIG. 6 for clarity. In FIG. 6, the end 64 of the spring 32 of the push-button actuator 30 is shown as being undeflected from the natural resting position of the spring 32. In other words, FIG. 6 illustrates the spring 32 in the natural resting position of the spring 32. In the exemplary embodiment, the edge sides 72 and 74 of the wedge 66 of the spring 32 are engaged in physical contact with the actuation surfaces 51 of the contact beams 26*a* and 26*b* when the spring 32 is in the natural resting position, as can be seen in FIG. 6. Alternatively, the edge sides 72 and 74 of the wedge 66 of the spring 32 are disengaged from physical contact with the actuation surfaces 51 of the contact beams 26*a* and 26*b* when the spring 32 is in the natural resting position.

As described above, the spring 32 can be deflected in the actuation direction F from the natural resting position to cause the wedge 66 to slidably engage the contact beams 26 and thereby move the contact beams 26 from the fully or partially closed positions to the open positions. As can be seen in FIG. 6, the actuation direction F is non-parallel to the insertion axis 24. In some embodiments, the actuation direction F is approximately perpendicular to the insertion axis 24 (e.g., in embodiments wherein the end 64 of the spring 32 deflects in a linear direction instead of along the arc E).

The contact beams 26*a* and 26*b* are shown in the fully closed position in FIG. 6. The end 64 of the spring 32 can be deflected in the actuation direction F to move the contact beams 26*a* and 26*b* from the fully closed positions to the open positions. As the wedge 66 of the spring 32 is deflected in the actuation direction F, the edge sides 72 and 74 of the wedge 66 slidably engage the actuation surfaces 51 of the of the contact beams 26*a* and 26*b*, respectively. In other words, the edge sides 72 and 74 slide along the actuation surfaces 51 (in engagement with the actuation surfaces 51) in the actuation direction F. The slidable engagement between the wedge 66 and the contact beams 26*a* and 26*b* moves the contact beams 26*a* and 26*b* along the respective arcs A and B in the respective directions C and D from the fully closed positions to the open positions.

FIG. 7 perspective view of a cross section of a portion of the electrical connector 10 illustrating the spring 32 as deflected in the actuation direction F (FIGS. 4 and 6). The contact beams 26*a* and 26*b* are shown in the open positions in FIG. 7. As should be apparent from a comparison of FIGS. 6 and 7, the wedge 66 of the spring 32 slidably engages the actuations surface 51 of each of the contact beams 26*a* and 26*b* to move the contact beams 26*a* and 26*b* to the open positions. In embodiments wherein the electrical contact 18 includes two contact beams 26, the wedge 66 of the spring 32 is received between the contact beams 26*a* and 26*b* to spread the contact beams 26*a* and 26*b* apart. Specifically, when the wedge 66 of the spring 32 is moved in the actuation direction F, the slidable engagement between the wedge 66 and the contact beams 26*a* and 26*b* moves the contact beams 26*a* and 26*b* to the open positions by spreading the contact beams 26*a* and 26*b* apart from each other. It should be understood that in embodiments wherein the electrical contact 18 includes a single contact beam 26, the wedge 66 of the spring 32 may slidably engage the single contact beam 26 in a substantially similar manner to either of the contact beams 26*a* or 26*b* to move the single contact beam from a closed position to an open position.

In the open positions shown in FIG. 7, the contact beams 26*a* and 26*b* of the electrical contact 18 are positioned such that an electrical wire 12 (FIGS. 1, 8, and 9) can be installed to the electrical contact 18. Specifically, the corresponding electrical wire 12 can be inserted, or poked, into the corresponding receptacle 20 along the insertion axis 24. As the electrical wire 12 is poked into the receptacle 20, the electrical wire 12 is received between the wire interfaces 28*a* and 28*b* of the contact beams 26*a* and 26*b*, respectively, and between the wedge 66 and the base 38 (FIGS. 2, 3, and 8) of the electrical contact 18, for example as should be apparent from a comparison of FIGS. 8 and 9). The contact beams 26*a* and 26*b* can then be moved from the open positions to the partially closed positions such that the wire interfaces 28*a* and 28*b* engage the electrical wire 12 and thereby establish an electrical connection between the electrical contact 18 and the electrical wire 12. Specifically, the spring 32 can be released such that the resilience of the spring 32 (i.e., the bias of the spring 32 to the natural resting position) moves the end 64 of the spring 32 back to the natural resting position of the spring 32. With the spring 32 being released, the resilience of the contact beams 26*a* and 26*b* (and additionally the bias provided by the spring beams 76 if included) causes the contact beams 26*a* and 26*b* to move to the partially closed positions.

In some alternative embodiments, the push-button actuator 30 is not used to install the electrical wire 12 to the electrical contact 18. For example, the spring 32 may remain in the undeflected natural resting position and the insertion force exerted by the electrical wire 12 on the contact beams 26*a* and/or 26*b* may be sufficient to move the contact beams 26*a* and/or 26*b* from the fully closed position toward the open position a sufficient amount such that the electrical wire 12 can be captured between the wire interfaces 28*a* and 28*b* without deflecting the spring 32.

FIG. 8 is a perspective view of a cross-section of the electrical connector 10 illustrating an electrical wire 12 installed to the electrical contact 18. The contact beams 26*a* and 26*b* are shown in the partially closed positions in FIG. 8. The wire interfaces 28*a* and 28*b* of the contact beams 26*a* and 26*b*, respectively, are engaged with the electrical wire 12 to electrically connect the electrical contact 18 to the electrical wire 12.

Figure 9:
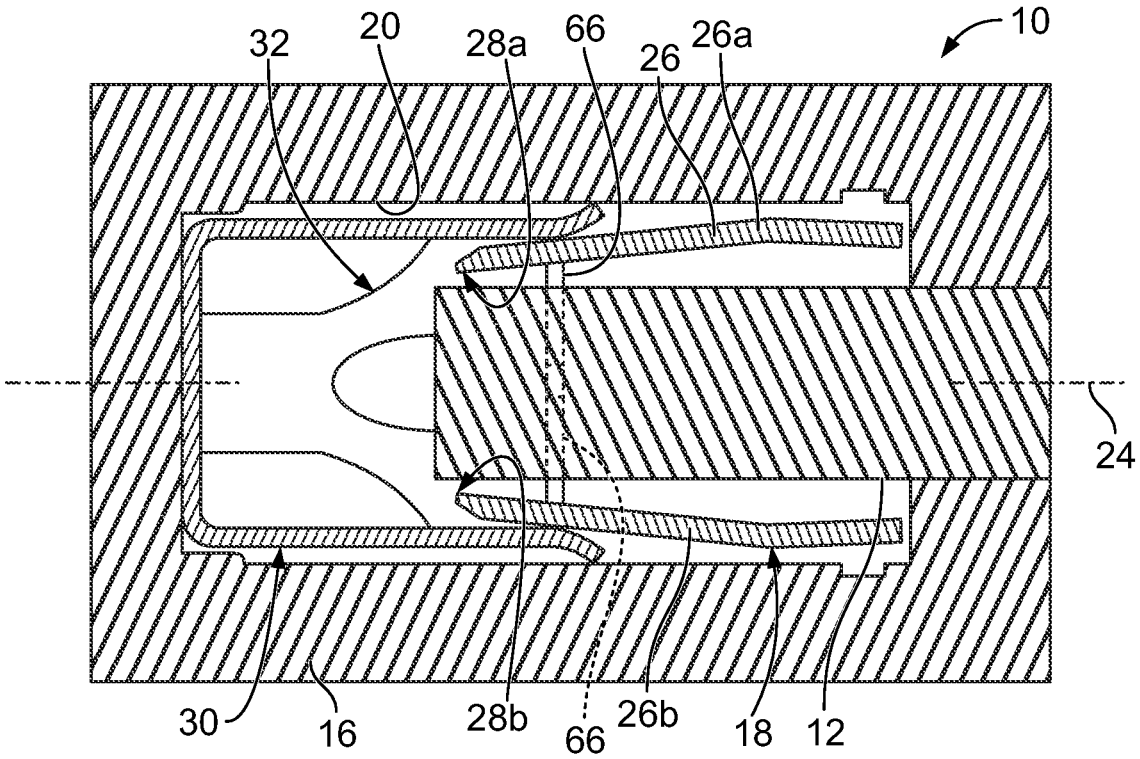
FIG. 9 is a cross-sectional view of a portion of the electrical connector shown in FIGS. 1 and 5-8 illustrating an open position of the electrical contact wherein the electrical wire can be uninstalled from the electrical contact.

To uninstall the electrical wire 12 from the electrical contact 18, the end 64 (FIGS. 4, 6, and 7) of the spring 32 (FIGS. 1, 4, 6, 7, and 9) is deflected in the actuation direction F as described above. Referring now to FIG. 9, and as described above with respect to FIG. 7, when the spring 32 is sufficiently deflected in the actuation direction F the wedge 66 is engaged with the contact beams 26*a* and 26*b* such that the contact beams 26*a* and 26*b* are in the open positions. In the open positions, the wire interfaces 28*a* and 28*b* of the contact beams 26*a* and 26*b*, respectively, are disengaged from the electrical wire 12. The open positions of the contact beams 26*a* and 26*b* represent an open position of the electrical contact 18 wherein the electrical wire 12 can be uninstalled from the electrical contact 18. Specifically, the electrical wire 12 can be pulled along the insertion axis 24 to remove the electrical wire 12 from the electrical contact 18 and from the corresponding housing receptacle 20.

Referring again to FIG. 8, when the electrical wire 12 installed to the electrical contact 18 as shown in FIG. 8, the inner sides 80 of the spring beams 76*a* and 76*b* of the push-button actuator 30 are engaged in physical contact with the outer sides 46 of the contact beams 26*a* and 26*b*, respectively, of the electrical contact 18. In the open positions of the contact beams 26, the spring beams 76*a* and 76*b* have been deflected from the natural resting positions thereof in the respective directions I and J. The resilience of the spring beams 76*a* and 76*b* (i.e., the bias of the spring beams 76*a* and 76*b* to the natural resting positions thereof) biases the contact beams 26*a* and 26*b* to the fully closed position. The spring beams 76*a* and 76*b* thus increase the inherent bias of the contact beams 26*a* and 26*b* to the fully closed positions, which increases the retention force exerted by the contact beams 26*a* and 26*b* on the electrical wire 12 to hold the electrical wire 12 and the contact beams 26 in electrical and mechanical connection.

Accordingly, the spring beams 76 provide the electrical contact 18 with a greater retention force than the retention force provided by the contact beams 26 alone. The increased retention force may enable the electrical contact 18 to accommodate a greater range of differently sized electrical wires 12. Moreover, as described above, the spring beams 76 may be fabricated from one or more different materials than the contact beams 26 of the electrical contact 18 to provide the spring beams 76 of the push-button actuator 30 with a greater yielding tensile strength than the contact beams 26 of the electrical contact 18. For example, the contact beams 26 may be fabricated from copper, while the spring beams 76 may be fabricated from stainless steel, which has a greater yielding tensile strength than copper. The greater yielding tensile strength of the spring beams 76 may facilitate providing an even greater increase in the retention force than embodiments wherein the contact beams 26 and the spring beams 76 are fabricated from the same material(s), which may enable the electrical contact 18 to accommodate an even greater range of different sizes of electrical wires 12.

Figure 10:
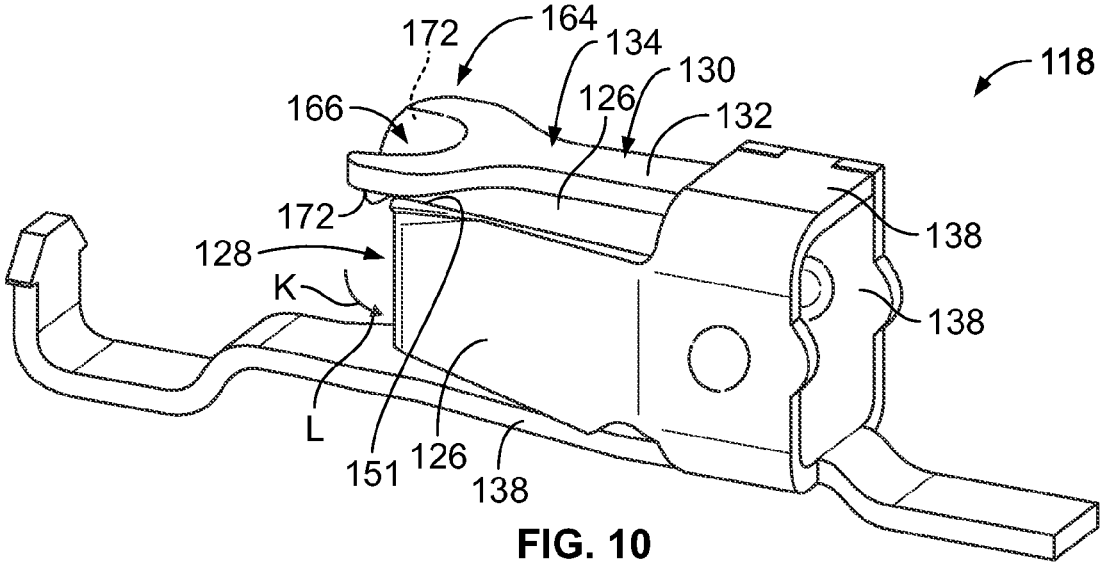
FIG. 10 is a perspective view of another exemplary embodiment of an electrical contact that may be used with the electrical connector shown in FIGS. 1 and 5-9.
Figure 11:
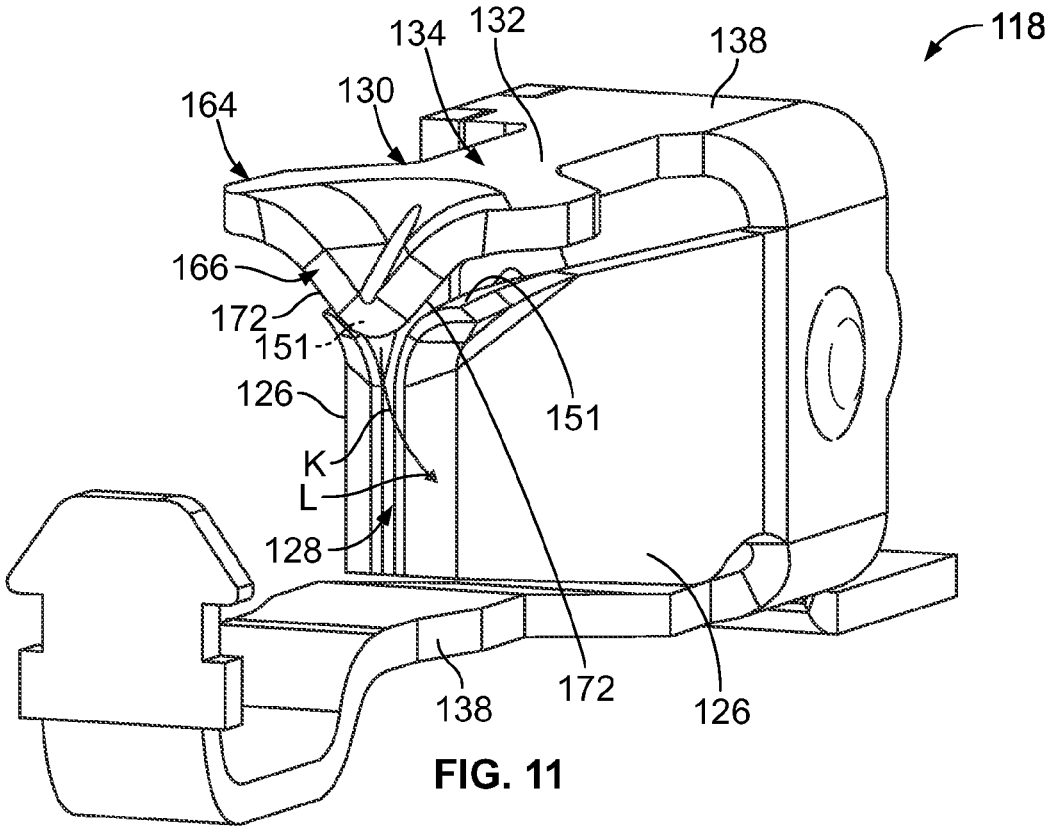
FIG. 11 is another perspective view of the electrical contact shown in FIG. 10 viewed from a different angle than FIG. 10.

As described above, the push-button actuator 30 is not limited to being a discrete component from the electrical contact 18. Rather, the push-button actuator 30 may be integrally formed with the electrical contact 18. For example, FIGS. 10 and 11 are perspective views of an exemplary embodiment of an electrical contact 118. As will be described below, the electrical contact 118 includes a push-button actuator 130 that includes a spring 132 that is integrally formed with the electrical contact 118.

The electrical contact 118 includes a base 138 and one or more of contact beams 126 that extend from the base 138. The contact beams 126 include actuation surfaces 151 where the spring 132 slidably engages the contact beams 126. The contact beams 126 include wire interfaces 128 where the contact beams 126 are configured to engage the corresponding electrical wire 12 (FIGS. 1, 8, and 9) to thereby form an electrical connection between the electrical contact 118 and the corresponding electrical wire 12. Each of the contact beams 126 may be referred to herein as a "first" and/or a "second" contact beam. Each of the wire interfaces 128 may be referred to herein as a "first" and/or a "second" wire interface.

The push-button actuator 130 is integrally formed with a portion of the electrical contact 118 such that the electrical contact 118 and the push-button actuator 130 define an integral structure. Accordingly, the push-button actuator 130 and the electrical contact 118 form a one-piece design, as opposed to the two piece design of the discrete electrical contact 18 (FIGS. 1-3 and 5-9) and push-button actuator 30 (FIGS. 1 and 4-9). In the exemplary embodiment, the push-button actuator 130 is integrally formed with the base 138 of the electrical contact 118, but the push-button actuator 130 may be additionally or alternatively integrally formed with any other portion of the electrical contact 118 (e.g., with one or more of the contact beams 126).

The push-button actuator 130 includes the spring 132, which extends a length outward from the base 138 to an end 164 of the spring 132. In the exemplary embodiment, the end 164 of the spring 132 includes a wedge 166. The wedge 166 is configured to slidably engage the contact beams 126 to move the contact beams 126 from partially closed positions to open positions and thereby enable the corresponding electrical wire 12 to be removed, or uninstalled, from the electrical contact 118. The wedge 166 is also configured to slidably engage the contact beams 126 to move the contact beams 126 from fully closed positions to the open positions and thereby enable the corresponding electrical wire 12 to be installed to the electrical contact 118. The spring 32 may be referred to herein as an "actuator". The wedge 66 includes actuation surfaces 172 where the wedge 166 slidably engages the contact beams 126 of the electrical contact 118. The wedge 166 is not limited to being located at the end 164 of the spring 132. Rather, the wedge 166 may have any other location along the length of the spring 132 that enables the wedge 166 to function as described and/or illustrated herein.

The spring 132 is resiliently deflectable from a natural resting position of the spring 132. Specifically, the end 164 of the spring 132 is resiliently deflectable along an arc K in an actuation direction L. The spring 132 is shown in the natural resting position in FIGS. 10 and 11. Deflection of the spring 132 in the actuation direction L slides the wedge 166 of the spring 132 along the contact beams 126 in engagement therewith. In other words, the wedge 166 and the contact beams 126 slidably engage each other as the spring end 164 deflects in the actuation direction L.

In the exemplary embodiment, the actuation surface 172 of the wedge 166 of the spring 132 are disengaged from physical contact with the actuation surfaces 151 of the contact beams 126 when the spring 132 is in the natural resting position, as can be seen in FIGS. 10 and 11. Alternatively, the actuation surfaces 172 of the wedge 166 engaged in physical contact with the actuation surfaces 151 of the contact beams 126 when the spring 132 is in the natural resting position.

The spring 132 includes a push button 134 that can be used to deflect the spring 132 in the actuation direction L and thereby slide the spring 132 along the contact beams 126. The push button 134 may have any location along the length of the spring 132 that enables the push button 134 to function as described and/or illustrated herein. In some embodiments, the push button 134 and/or the windows 36 (FIG. 1) of the housing 16 (FIGS. 1 and 5-9) are configured (e.g., sized, shaped, positioned, and/or the like) such that a special dedicated tool is not required to push the push button 134 and thereby deflect the spring 132 in the actuation direction L. For example, a user may push the push button 134 and thereby deflect the spring 132 using a conventional tool (e.g., a pencil, a pen, a wire, a rod, and/or the like), using a body part (e.g., a person's finger, thumb, and/or the like), and/or the like.

The push-button actuator 130 and the reminder of the electrical contact 118 may each be fabricated from any material (s), such as, but are not limited to, copper, gold, silver, aluminum, nickel, platinum, and/or the like. Optionally, the push-button actuator 130 and/or another portion of the electrical contact 118 includes a base material (not shown) that is coated (e.g., plated and/or the like) with one or more different materials. Fabricating the spring 132 and/or other portions of the push-button actuator 130 from one or more metallic materials may facilitate preventing damage to the spring 132 from heat experience during a solder reflow operation.

Operation of the push-button actuator 130 to move the contact beams from the fully and partially closed positions to the open positions is substantially similar to the operation of the push-button actuator 30 and therefore will not be described in more detail herein.

The embodiments described and/or illustrated herein may provide a an electrical contact having a wire interface that can be disengaged from an electrical wire. The embodiments described and/or illustrated herein may provide an electrical contact that enables an electrical wire to be inserted into and/or removed from a receptacle multiple times without damaging the electrical wire and/or the electrical contact. The embodiments described and/or illustrated herein may provide an electrical contact that can accommodate a greater range of different wire sizes than at least some known electrical contacts.

The embodiments described and/or illustrated herein may provide an electrical connector having an actuator for releasing an electrical wire from an electrical contact, wherein the actuator can be actuated to release the electrical wire without using a special dedicated tool. The embodiments described and/or illustrated herein may provide an electrical connector having an actuator for releasing an electrical wire from an electrical contact, wherein the actuator can be actuated using a conventional tool (e.g., a pencil, a pen, a wire, a rod, and/or the like), using a body part (e.g., a person's finger, thumb, and/or the like), and/or the like.

The embodiments described and/or illustrated herein may provide an electrical connector having an actuator for releasing an electrical wire from an electrical contact, wherein the actuator is less likely to be damaged when exposed to heat than the actuators of at least some known electrical connectors. For example, the actuator may be less likely to be damaged when exposed to heat than actuators fabricated from non-metallic (e.g., plastic) materials.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector comprising:

a housing having a receptacle that is configured to receive an electrical wire therein;

an electrical contact held by the housing, the electrical contact comprising a contact beam that includes a wire interface that is configured to engage the electrical wire, the contact beam being movable between a closed position and an open position, the wire interface being configured to engage the electrical wire when the contact beam is in the closed position, the wire interface being configured to be disengaged from the electrical wire when the contact beam is in the open position; and a push-button actuator separately provided from the housing and manufactured from a different material than the housing, the push-button actuator being secured to the housing and positioned for actuation of the contact beam, the push-button actuator comprising a resiliently deflectable spring that is configured to slidably engage the contact beam to thereby move the contact beam from the closed position to the open position.

2. The electrical connector of claim 1, wherein the spring comprises a wedge that is configured to slidably engage the contact beam to move the contact beam from the closed position to the open position.

3. The electrical connector of claim 1, wherein the contact beam is a first contact beam and the wire interface is a first wire interface, the electrical contact comprising a second contact beam that includes a second wire interface that opposes the first wire interface, the first and second contact beams being configured to receive the spring of the push-button actuator therebetween to spread the first and second contact beams apart as the spring slidably engages the first and second contact beams.

4. The electrical connector of claim 1, wherein the receptacle of the housing is configured to receive the electrical wire therein along an insertion axis, the spring of the push-button actuator being configured to slidably engage the contact beam along an actuation direction that is non-parallel to the insertion axis.

5. The electrical connector of claim 1, wherein the contact beam of the electrical contact comprises a wire side and an opposite side, the wire side including the wire interface of the contact beam, the push-button actuator comprising a spring beam extending along the contact beam and being engaged in physical contact with the opposite side of the contact beam to push the contact beam toward and into the electrical wire.

6. The electrical connector of claim 1, wherein the contact beam is a first contact beam and the wire interface is a first wire interface, the electrical contact comprising a second contact beam that includes a second wire interface that opposes the first wire interface, the push-button actuator comprising first and second spring beams, the first and second contact beams being received between the first and second spring beams such that the first and second spring beams flank on opposite sides the first and second contact beams and such that the first and second contact beams are engaged in physical contact with the first and second spring beams, respectively.

7. The electrical connector of claim 1, wherein the spring of the push-button actuator is integrally formed with the electrical contact.

8. The electrical connector of claim 1, wherein the spring of the push-button actuator is a discrete component from the electrical contact.

9. The electrical connector of claim 1, wherein the spring of the push-button actuator is a discrete component from the electrical contact, the spring including a different material than the contact beam of the electrical contact.

10. The electrical connector of claim 1, wherein the spring of the push-button actuator comprises a push-button that is configured to be pushed to slide the spring along the contact beam, the push-button being exposed through a window of the housing.

11. The electrical connector of claim 1, wherein the spring is configured to be deflected from a natural resting position of the spring to slide the spring along the contact beam.

12. The electrical connector of claim 1, wherein the contact beam of the electrical contact comprises a wire side that includes the wire interface, the spring of the push-button actuator being configured to slidably engage an edge of the wire side of the contact beam.

13. The electrical connector of claim 1, wherein the spring engages the contact beam at an actuation surface of the spring, the actuation surface being disengaged from physical contact with the contact beam when the spring is undeflected from a natural resting position of the spring.

14. An electrical connector comprising:

a housing having a receptacle that is configured to receive an electrical wire therein;

an electrical contact held by the housing, the electrical contact comprising a contact beam that includes a wire interface that is configured to engage the electrical wire, the contact beam being movable between a closed position and an open position, the wire interface being configured to engage the electrical wire when the contact beam is in the closed position, the wire interface being configured to be disengaged from the electrical wire when the contact beam is in the open position; and a push-button actuator being manufactured from a metal material and comprising a metal spring that is configured to be resiliently deflected and thereby moved relative to the contact beam such that slidable engagement between the spring and the contact beam moves the contact beam from the closed position to the open position.

15. The electrical connector of claim 14, wherein the spring comprises a wedge that is configured to slidably engage the contact beam to move the contact beam from the closed position to the open position.

16. The electrical connector of claim 14, wherein the receptacle of the housing is configured to receive the electrical wire therein along an insertion axis, the spring of the push-button actuator being configured to be deflected in a deflection direction that is non-parallel to the insertion axis to move the contact beam from the closed position to the open position.

17. The electrical connector of claim 14, wherein the contact beam of the electrical contact comprises a wire side and an opposite side, the wire side including the wire interface of the contact beam, the push-button actuator comprising a spring beam that is engaged in physical contact with the opposite side of the contact beam.

18. The electrical connector of claim 14, wherein the spring of the push-button actuator is integrally formed with the electrical contact.

19. The electrical connector of claim 14, wherein the contact beam is a first contact beam and the wire interface is a first wire interface, the electrical contact comprising a second contact beam that includes a second wire interface that opposes the first wire interface, the first and second contact beams being configured to receive the spring of the push-button actuator therebetween to spread the first and second contact beams apart as the spring slidably engages the first and second contact beams.

20. An electrical connector comprising:

a housing having a receptacle that is configured to receive an electrical wire therein;

an electrical contact held by the housing, the electrical contact comprising a contact beam that includes a wire interface that is configured to engage the electrical wire, the contact beam having a wire side and an opposite side, the wire side including the wire interface of the contact beam, the contact beam being movable between a closed position and an open position, the wire interface being configured to engage the electrical wire when the contact beam is in the closed position, the wire interface being configured to be disengaged from the electrical wire when the contact beam is in the open position; and a push-button actuator comprising a resiliently deflectable spring and a spring beam, the spring being configured to slidably engage the contact beam to thereby move the contact beam from the closed position to the open position, the spring beam being engaged in physical contact with the opposite side of the contact beam for biasing the contact beam to the closed position.

* * * * *